US005619848A

United States Patent [19]

Costales et al.

[11] Patent Number: 5,619,848

[45] Date of Patent: Apr. 15, 1997

[54] METHOD AND APPARATUS FOR AUTOMATICALLY REMOVING AN IMPERFECTION FROM SPUN FILAMENT YARN AND STAPLE FIBERS

[75] Inventors: Manual Costales, Belmont, N.C.; Mark J. Yukob, Clover, S.C.; Charles W. Proctor, Greensboro, N.C.

[73] Assignee: Prospin Industries, Inc., Greensboro, N.C.

[21] Appl. No.: 512,953

[22] Filed: Aug. 9, 1995

[51] Int. Cl.[6] ..... D01H 11/00; D01H 13/04

[52] U.S. Cl. ..... 57/261; 57/3; 57/6; 57/12; 57/19; 57/22; 57/86; 57/87; 57/279; 57/280; 57/328

[58] Field of Search ..... 57/261, 22, 3, 57/12, 6, 19, 279, 280, 328, 86, 87, 333

[56] References Cited

U.S. PATENT DOCUMENTS

| | | | |
|---|---|---|---|
| 3,342,028 | 9/1967 | Matsubayashi et al. | 57/163 |
| 3,343,356 | 9/1967 | McKinnon | 57/12 |
| 3,350,867 | 11/1967 | Morrison et al. | 57/12 |
| 3,822,543 | 7/1974 | Edagawa et al. | 57/160 |
| 3,845,611 | 11/1974 | Senturk et al. | 57/5 |
| 3,940,917 | 3/1976 | Strachan | 57/152 |
| 4,069,659 | 1/1978 | Arai et al. | 57/160 |
| 4,296,597 | 10/1981 | Tani et al. | 57/205 |
| 4,489,540 | 12/1984 | Faure et al. | 57/5 |
| 4,497,167 | 2/1985 | Nakahara et al. | 57/328 |
| 4,559,773 | 12/1985 | Stahlecker | 57/261 |
| 4,614,081 | 9/1986 | Kim | 57/12 |
| 4,712,365 | 12/1987 | Ferrer | 57/12 |
| 4,757,680 | 7/1988 | Berger et al. | 57/328 |
| 4,848,072 | 7/1989 | Sakai et al. | 57/261 |
| 4,866,924 | 9/1989 | Stahlecker | 57/243 |
| 4,921,756 | 5/1990 | Tolbert et al. | 428/373 |
| 4,928,464 | 5/1990 | Morrison | 57/224 |

FOREIGN PATENT DOCUMENTS

| | | |
|---|---|---|
| 35-049 | 4/1978 | Japan . |
| 53-122829 | 10/1978 | Japan . |
| 60-15729 | 4/1985 | Japan . |
| 3112727 | 5/1988 | Japan . |

*Primary Examiner*—William Stryjewski
*Attorney, Agent, or Firm*—Darby & Darby

[57] ABSTRACT

A method and apparatus for automatically removing a slub from spun filament yarn and a sliver or roving of staple fibers. The sliver or roving of staple fibers are fed through a drafting apparatus to prepare a continuous bundle of staple fibers. The filament yarn is pretensioned such that a texture is temporarily substantially removed. The continuous bundle of staple fibers and the filament yarn are combined downstream of the drafting apparatus. The combined continuous bundle and the filament yarn are fed into a spinner. The spun filament yarn and staple fibers are monitored to detect imperfections of a predetermined magnitude. A first signal is generated upon detection of an imperfection of the predetermined magnitude. The feeding of the staple fibers is stopped in response to the first signal. The core yarn is clamped at a predetermined position in response to the first signal. The core yarn is cut downstream of the predetermined position and upstream of the combining position in response to the first signal. The stopping of the feeding, the clamping of core yarn and the cutting of the core yarn all take place substantially simultaneously. Upon the arrival of a splicer, the clamping of the core yarn is released, the tension on the core yarn is released and a downstream feeding force is applied to the untensioned core yarn. The splicer removes a predetermined amount of the spun filament yarn and staple fibers from both upstream and downstream of the position of the imperfection, splices the yarn back together and releases the yarn to permit continued manufacture of composite spun core yarn, all without requiring any manual assistance.

15 Claims, 3 Drawing Sheets

METHOD AND APPARATUS FOR AUTOMATICALLY REMOVING AN IMPERFECTION FROM SPUN FILAMENT YARN AND STAPLE FIBERS

FIELD OF THE INVENTION

The present invention relates to an apparatus and process for automatically removing an imperfection from spun filament yarn and staple fibers. More specifically, the present invention relates to an apparatus and process for automatically removing an imperfection from spun filament yarn, which has been tensioned, and staple fibers.

BACKGROUND OF THE INVENTION

The basic concept of spinning fibers is centuries old. Spinning staple fibers into useful threads and yarns improved their overall strength, to a limited extent, and allowed the final yarn to be spun with varying degrees of thickness, strength, etc.

With the advent of synthetic textile fibers, the possibility arose for producing continuous filament yarns with greater strength and more durability than those from staple fibers, and also no shrinkage. Accordingly, it has become possible to produce knitted and woven fabrics for apparel, home furnishing and industrial use. The shrinkage of these fabrics can be controlled by using a yarn where the heat annealing point of the polyester fiber which is spun into the continuous filament state has been exceeded. Products made from polyester yarn have excellent strength properties, dimensional stability and good color fastness to washing, dry cleaning and light exposure. The use of 100% polyester knit and woven fabrics became extremely popular during the late 1960's and through the 1970's. More recently, continuous filament polyester fiber has also been cut into staple where it can be spun into 100% polyester staple yarns or blended with cotton or other natural fibers. However, both 100% polyester and polyester blended yarns and fabric made from these yarns have a shiny anti synthetic appearance, are clammy and prone to static conditions in low humidity, and tend to be hot and sticky in high humidity conditions. Additionally, polyester fiber, because of its high tensile strength, is prone to pilling in staple form and picking in continuous filament form.

Conventional methods of blending cotton and synthetics together have been less than fully successful as both mechanical and intermittent blends of polyester and cotton tend to pill, pick, shrink and are uncomfortable to wear. The consumer's use of polyester and polyester blended fabrics has been reduced over recent years in favor of 100% cotton fabrics which offer good appearance and comfort. This is especially true in the apparel industry. However, the use of 100% cotton yarn and fabrics also has its disadvantages. Primarily, fabrics made of 100% natural cotton tend to shrink and wrinkle. The most popular method of controlling cotton shrinkage for apparel outerwear is to coat the cotton fabric with resins made with formaldehyde. However, formaldehyde is considered to be a hazardous chemical and is therefore dangerous to handle during processing and is also considered dangerous on any fabrics that come into contact with the body because formaldehyde is a known carcinogen. Additionally, formaldehyde-based resins, when used to control the shrinkage of cotton or cotton blend fabrics, degrade the abrasion resistance and strength properties of the fabric, thus making them more prone to fabric holes, tearing and scuffing.

The use of prewashing to control shrinkage is also less than satisfactory because it is wasteful in terms of the energy consumed and it also gives garments a worn appearance. Mechanical compaction has also been used to control the shrinkage of cotton fabrics. However, this process is expensive because of the high working loss and it is also not a permanent solution as compacted garments tend to return to their pre-compacted dimensions. For these reasons, the treating of cotton by resin is the currently preferred method to control the shrinkage of cotton fabrics. However, because most resins contain formaldehyde, the fabrics treated with resin are unsafe both during the manufacturing process and during their use by the consumer.

Accordingly, there was a need in the art to produce yarns that have both the positive qualities of cotton fibers and synthetic filaments while eliminating their respective negative qualities. Applicant's commonly owned U.S. Pat. No. 5,383,331 and co-pending application Ser. No. 08/354,279 filed on Dec. 12, 1994 are each directed towards a composite yarn and a process for producing a composite yarn that comprises a filament yarn which is stretched to a second thickness that is less than a first thickness of the filament yarn in a relaxed state. Thereafter, the staple fiber covers the filament yarn component and confines the filament yarn component to a thickness which is less than the first thickness. The disclosures of U.S. Pat. No. 5,383,331 and co-pending Ser. No. 08/354,279, are hereby incorporated by reference.

Murata Machinery, Ltd. of Kyoto, Japan manufactures and sells a "high-speed type murata jet spinner" through Muratech of America Inc., 2120 I85 South, Charlotte, N.C. 28266. The Murata jet spinner can be utililzed to combine a core with an outer wrapping of fibers. However, with any of the known air-jet spinners it has been impossible to achieve a tight enough wrapping of fibers around a core to prevent slippage or pulling in the final yarn. The Murata jet-spinner (MJS) machine includes an MJS splicer which has been used to automatically remove an impurity or imperfection (known in the art as a slub) from the combined, spun yarn. Hereinafter, Applicants will refer to the slub as an imperfection, it being understood that this term is to be construed broadly and should include impurities as well as breaks in the yarn. A single splicer has been used to service a number of spinners, which are arranged in a parallel manner. The splicer travels back and forth in front of the row of spinners and automatically stops in front of the spinner where it is needed. Upon the detection, by a sensor, of a slub of a predetermined magnitude or greater, the MJS splicer is summoned to the station. Simultaneously, the feeding of the core and outer wrapper of fibers is stopped. Upon arrival, the splicer cuts the spun, combined yarn in the area between the last nip roll and the take-up roll and removes a predetermined amount of the spun yarn from the take-up package as well as a predetermined amount from upstream of the imperfection. The splicer then splices the yarn from the take-up package with the yarn from the jet-spinners. Accordingly, the MJS splicer automatically removes a slub from the spun, combined yarn, and splices the remaining yarn ends back together. However, Applicant's have discovered that the automated MJS splicer will not work automatically when the core yarn is tensioned as is the case in applicant's commonly owned U.S. Pat. No. 5,383,331 and Ser. No. 08/354,279. Accordingly, upon the detection of a slub in an installation based on the '331 patent and '279 application configuration, the spun combined yarn must be manually fed into the MJS splicer, to overcome the tensile force on the core. Thereafter the imperfection is removed in a conventional manner.

Thus, there is a need in the art to permit an automatic removal of an imperfection from spun, combined yarn, where the core yarn is under tension.

SUMMARY OF THE INVENTION

The present invention is directed to an assembly and a method for automatically removing a slub from a combined, spun multifilament tensioned yarn and sliver or roving of staple fibers.

In a preferred embodiment demonstrating further objects, features and advantages of the present invention, the multifilament core yarn is pretensioned before entering a spinning chamber where it is cospun with the staple fibers. The tension is relaxed after passing through the spinning chamber to allow the filament of the core to expand and form a matrix to which the staple fibers can adhere. The combined spun yarn then passes by a sensor which detects any imperfections in the two-component composite yarn. Upon the detection of an imperfection which is above a predetermined magnitude, the feeding of the staple fibers is stopped. Simultaneously, the core yarn is clamped at a predetermined position between a pretensioning device and the location where the core yarn is combined with the staple fiber. The core yarn is cut just downstream of the clamping position, thereby releasing the tension on the downstream portion of the yarn. At the same time the splicer is summoned to the station where the imperfection has been detected. Substantially simultaneously with the arrival of the splicer, the clamping force on the core yarn is released and the tension applied to the core yarn by the pretensioning device is released. The new leading end of the core yarn is then fed by a downstream feeding force (in the form of a pneumatic force applied to the core yarn) just downstream of the pretension device and upstream of the clamping device. The feeding of the staple fibers is restarted. The core yarn and the staple fibers are combined and spun and fed through the front nip rolls. It should be noted that at this time the core yarn is not under tension and any spun yarn provided with this untensioned core will be removed by the splicer. The tension is then reapplied to the core yarn and the splicer then splices the trailing end of the yarn from the take up package to the new leading end of the newly produced composite yarn after yarn has been produced having the required core pretension. After splicing, the manufacture of the composite spun yarn continues automatically until the next imperfection exceeding a predetermined magnitude is detected by the sensor.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENTS

In the following description, it is to be understood that such terms as "upstream", "downstream". "forward", "rearward", "left", "right" and the like are words of convenience and are not to be construed as limiting terms.

Figure 1:
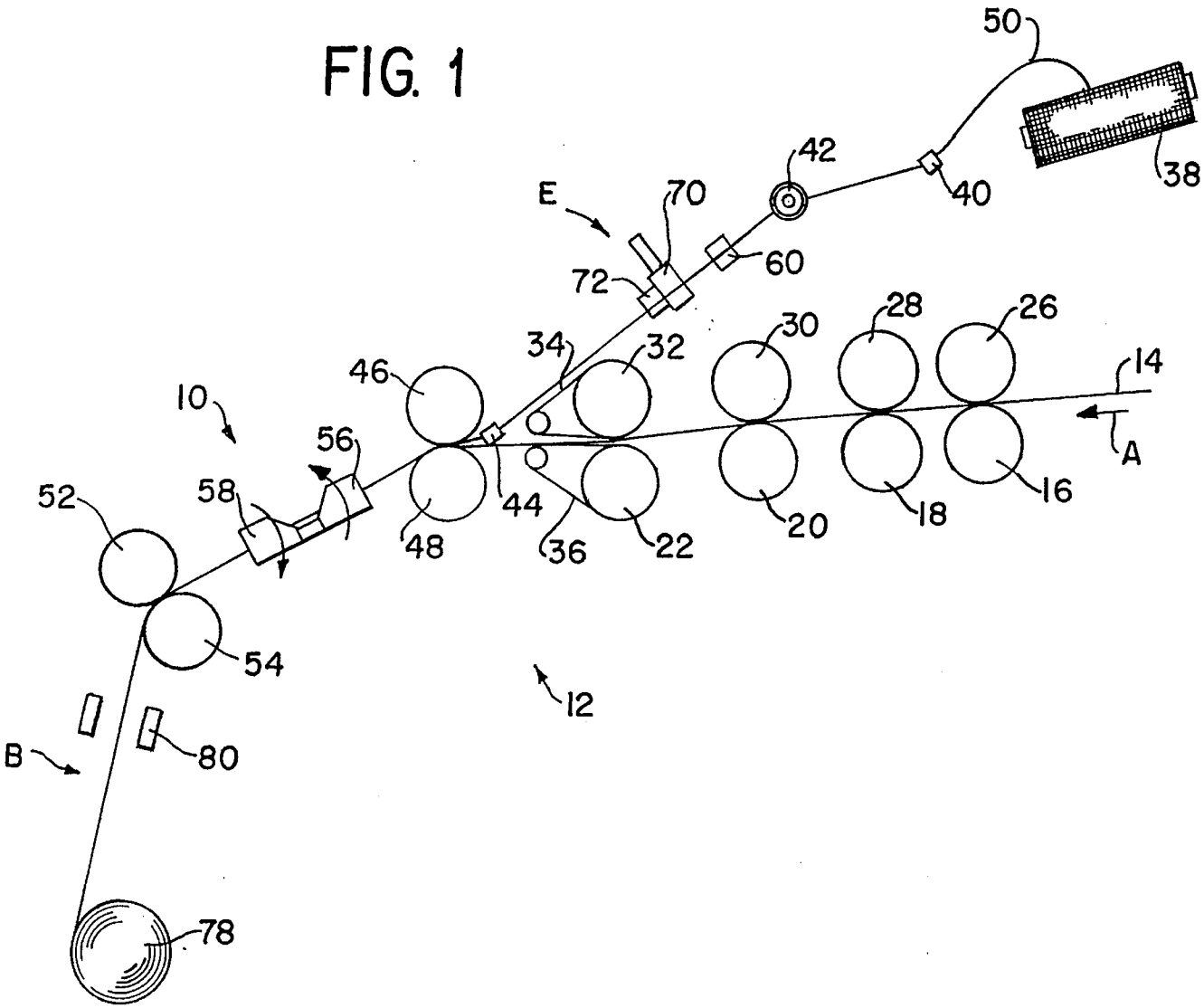
FIG. 1 is a schematic representation of a yarn spinning apparatus constructed according to the present invention.
Figure 2:
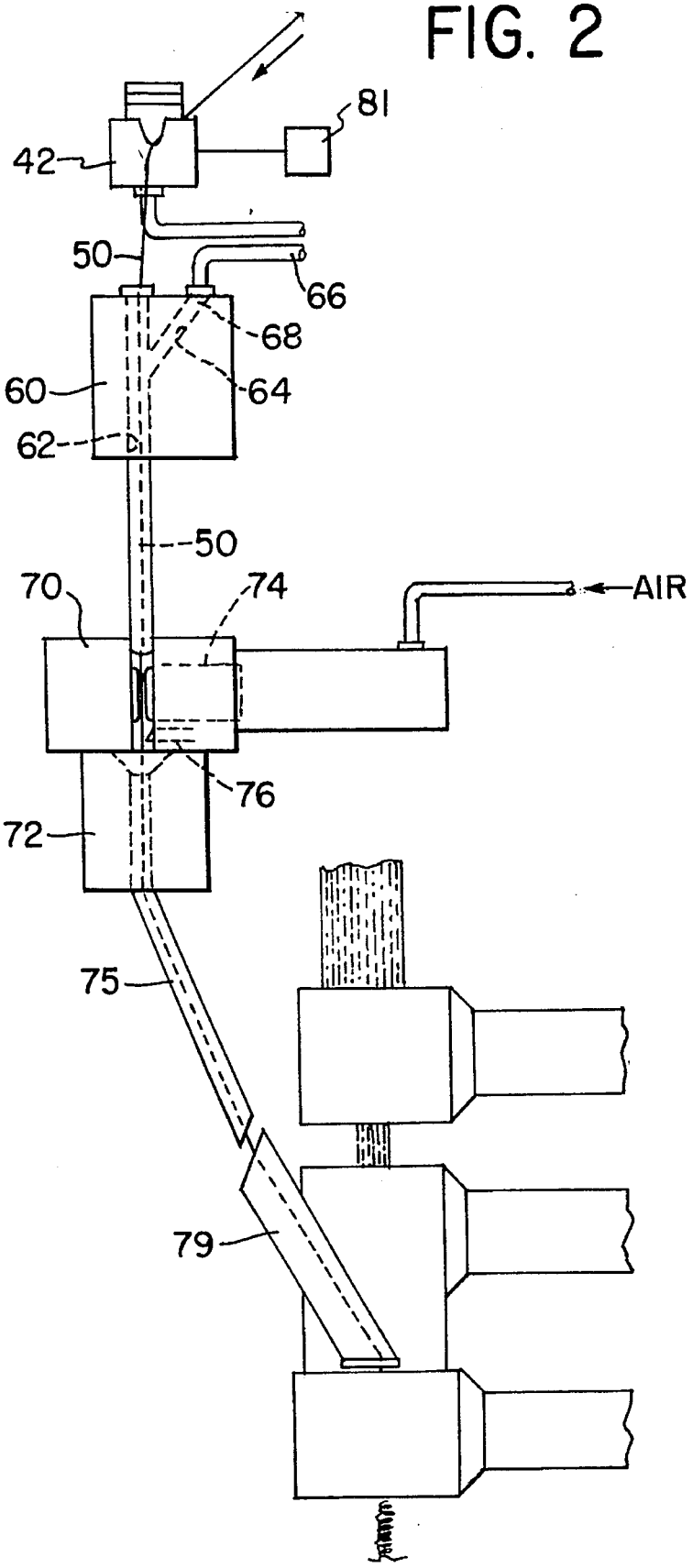
FIG. 2 is a partially magnified schematic view of the yarn spinning apparatus.

Now referring to the drawings, as best seen in FIG. 1, there is shown a 'schematic representation of a yarn spinning apparatus, generally designated as 10, constructed according to the present invention.

Spinning apparatus 10 includes a drafting frame 12 to which a staple sliver 14 is fed in the direction of arrow "A" . In the drafting frame 12, a staple sliver 14, such as from cotton, is drawn to the desired size, as is known in the art. The drafting frame 12 preferably has bottom rollers 16,18, 20,22 and top pressure rollers 26,28,30,32. Top and bottom aprons 34,36 are driven by rollers 32,22, respectively, also as is known. The resulting staple sliver 14 are prepared to be spun. In a preferred embodiment, the staple sliver 14 is a cotton fiber made from pima cotton or a blend of pima cotton and long staple cotton because, in general, pima cotton is stronger than most other cottons. The use of pima cotton is preferred because of its relatively long staple fibers which average in length from 1.375 inches to 1.5 inches.

A stretch textured multifilament "reverse" S-twist (clockwise twist) yarn 50, such as a stretch "S"-twist 70 denier/34 filament yarn, is withdrawn from yarn supply 38 through guide 40, pretensioning device 42 and ceramic thread guide 44 located downstream of the aprons and before top and bottom nip rollers 46,48. The pretensioning device 42 is preferably an adjustable spring-loaded cymbal tension device that the multifilament yarn 50 is passed through so that the tension on the yarn can be adjusted to provide the best results. Other known tensioning devices may be employed.

When the stretch textured "S" twist multifilament yarn 50 is removed from its supply, it is in a crimped state with inter-filament gaps caused by the random abutment of adjacent crimps. The gaps also cause the yarn 50 to have an overall average thickness in its relaxed state substantially exceeding the average thickness in its tensioned state. It is to be understood that the preferred multifilament yarn is comprised of as many filaments as are necessary to produce the desired final composite yarn.

The yarn filaments exit in that crimped, expanded state from the yarn supply 38 to the pretensioning device 42. After the pretensioning device, the multifilament yarn is pulled by rollers 46, 48 sufficiently taut such that the crimp is temporarily substantially removed from the filaments. The multifilament yarn 50 is preferably a synthetic material, such as polyester, nylon, rayon, acrylic, polypropylene, spandex, acetate, asbestos, glass filament, polyolefin, carbon fiber, or quartz multifilament yarn. The overall average thickness has been significantly reduced by tensioning yarn 50 and temporarily removing the crimp.

The multifilament yarn 50, leaving pretensioning device 42, then enters a vortex generator 60 that has a through bore 62 to permit the passage of the multifilament yarn 50 therethrough and a second bore 64 that opens up in the shape of a vortex and is in fluid communication with the first through bore 62. A pneumatic supply line 66 is in communication with bore 62 and vortex bore 64. After passing through bore 62, multifilament yarn 50 then enters a cutting/clamping device 70 that has a connecting funnel 72 disposed directly below i.e., downstream of the cutting/clamping device 70. The connecting funnel 72 preferably has a ceramic internal conical surface to assist in guiding the yarn 50 downwardly. The cutting/clamping device 70 includes a clamping member 74 for holding the yarn 50 and a cutter member 76 for cutting the yarn 50 in a direction transverse to the direction of movement of the yarn. The cutter and clamper are pneumatically actuated to first clamp the multifilament yarn 50 and then to cut the yarn by actuation of cutting member 76 just below or downstream of the clamping position.

The filament yarn 50 passes through and then exits from the connecting funnel 72 where it enters a small feeder tube portion 75 which leads the multi filament yarn 50 into a larger feeder tube portion 79. Feeder tubes 75 and 79 are shown as being separated from one another to permit the large tube to be opened along with a cover for the front rollers to permit servicing of the front rollers. After passing through the large tube 79, the multifilament yarn 50 then enters between the top and bottom nip rollers 46, 48, which maintain the tension on the yarn 50. The tension is similarly maintained between the first nip rollers 46, 48 and second nip rollers 52, 54.

At the first nip rollers, the yarn 50 and the staple fibers 14 are combined and fed into the air-jet zone. The air-jet zone is preferably constructed as shown in U.S. Pat. No. 4,497,167. The cotton staple sliver 14 and the core filament yarn 50 enter the first air jet 56 where the loose cotton staple is wrapped around the core yarn 50 with a clockwise rotation. It is to be understood that the cotton staple fibers completely surround the core yarn. Upon leaving the second air jet 58, the combined yarn passes through second nip rollers 52,54, with the core still under tension.

After exiting from the second nip rollers 52, 54, the core 50 is finally released from its tension. However, it is now wrapped with and constrained by the surrounding staple fibers 14, which bind the core and prevent it from reaching its fully expanded state and thus, simultaneously become more taut themselves.

After exiting from the second nip rollers, the composite spun core yarn is wound on a take up package 78. However, prior to entering package 78, the yarn passes through a sensor 80 which detects imperfections in the composite spun yarn. If an imperfection of a certain predetermined minimum magnitude is detected, a signal is generated indicating that an imperfection (i.e., a slub) exists in the composite yarn, which slub must be removed to maintain the quality of the yarn being wound upon the take-up package. A signal can also be generated upon detecting a break in the composite yarn.

The operation of the present invention to automatically remove an imperfection from spun tensioned filament yarn and staple fibers will now be described. Upon activation of the signal, known as a red signal, the feeding of the staple fibers 14 is stopped, the cutting clamping unit 70 is actuated so that the core yarn 50 is clamped by clamping member 74 and shortly thereafter yarn 50 is cut just below the clamping member 74 by knife 76 at a location generally indicated by letter A in FIG. 1. The cutting of the yarn 50 by knife 76 releases the tension on the yarn downstream from that point. However, the core yarn 50 is still held in tension upstream of clamping member 74. A splicer unit 82, which traverses up and down the row of multiple spinning jet assemblies 10, is summoned. All of the above actions are achieved substantially simultaneously (with the exception that yarn 50 is first clamped by member 74 and is shortly thereafter cut by knife 76) by a control system (not shown).

Figure 3:
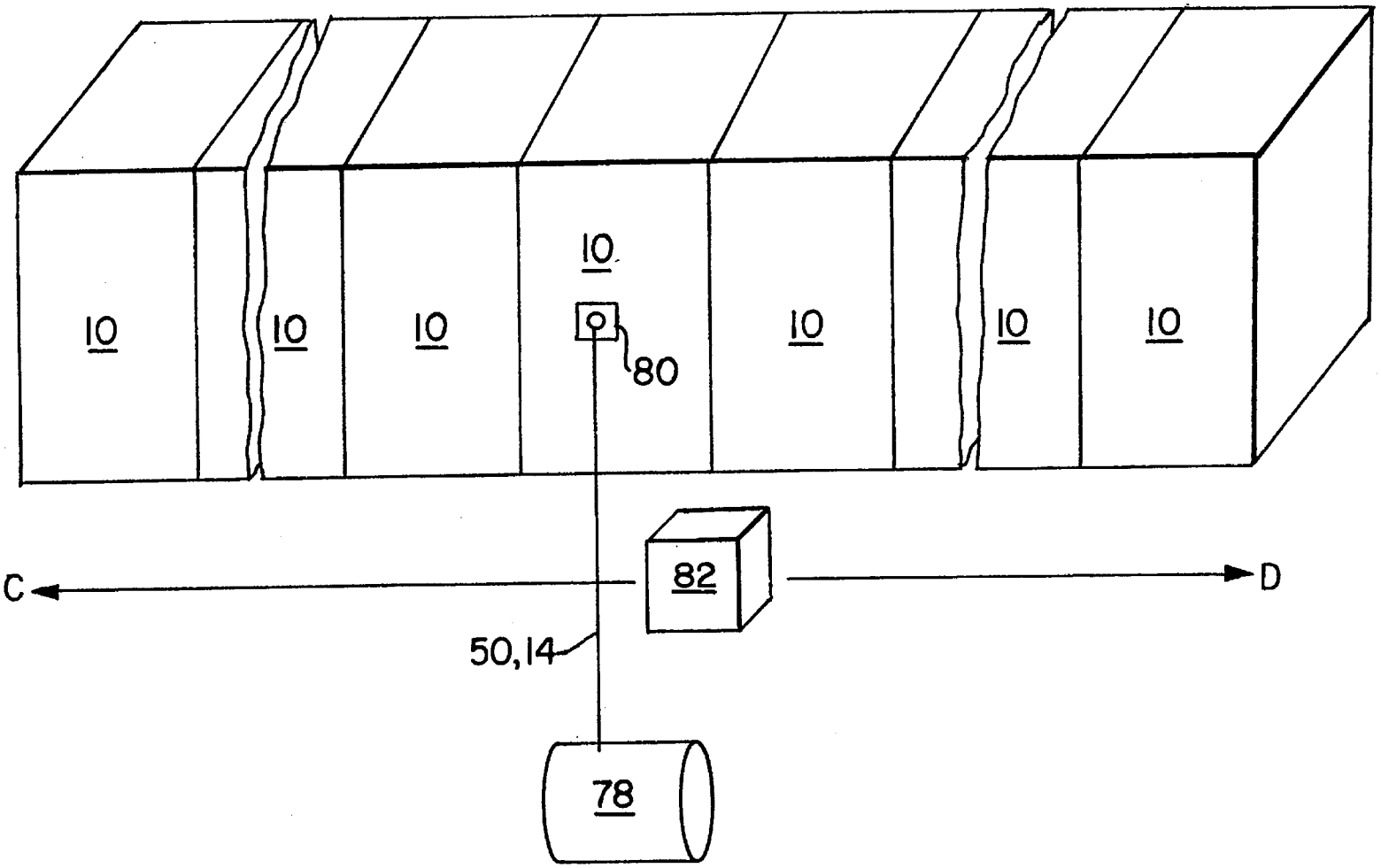
FIG. 3 is a schematic illustration of a row of yarn spinning apparatus according to the present invention.

In one embodiment (see FIG. 3) there could be as many as sixty to seventy-two spinning jet assemblies arranged in a row with one splicer 82 traversing back and forth along the entire row, in the direction indicated by arrows C and D, to attend to imperfections in the composite yarn when detected. When the splicer has reached its operative position, in response to the red signal, in front of the spinning jet assembly in which a slub has been detected, the splicer is positioned below the composite yarn between the last set of nip rolls 52, 54 and the take up package 78 and generally in the area of sensor 80. A second signal is then generated indicating the arrival and proper positioning of the, splicer in front of the spinning jet assembly. The splicer grasps the composite yarn, by an actuating arm in the area of the slub and thereafter cuts the yarn for a second time in a conventional manner at a location generally indicated by letter B in FIG. 1. In response to the second signal, the back rollers 16, 18, 20 and 22 are then activated to restart the feeding of the staple fibers 14. Substantially simultaneously therewith an air valve 81 is actuated to disengage the pretension device 42. In other words, the pretension device no longer applies tension to the yarn 50. The clamping portion 74 of the cutting/clamping device is opened and an air pulse is directed into the vortex generator device 60 through port 64. Because the core yarn 50 is no longer under tension and clamp 74 is now in a released or open position, the force generated by the air (or other pneumatic fluid) flowing through port 64, into a vortex chamber 65 and then into bore 62 within vortex generator 60 is sufficient to direct the core yarn 50 downwardly through the spliced feeder tube 75, 79 so that it recombines with the staple fiber 14 and is eventually fed to the front rollers 46, 48 and to the air jet spinners 56, 58. The leading end of the combined spun core yarn and staple fibers as well as the section of combined yarn which were cut between locations A and B are then picked up by the traversing splicer's suction nozzle in a conventional manner. It should be noted that at this time the core yarn is not under tension and any spun yarn produced with this untensioned core must be removed by the splicer. The tension is then reapplied to the core yarn and the splicer then splices the trailing end of the yarn from the take up package to the new leading end of the newly produced composite yarn, after yarn has been produced having the required core pretension. After splicing, the manufacture of the composite spun yarn continues automatically until the next imperfection is detected by the sensor. The newly generated core yarn and the core yarn from the take up package are both automatically positioned within the splicer by an actuating arm of the splicer. The splicer removes a predetermined amount of yarn, including the slub, from both upstream and downstream of the position where the yarn has been cut by the splicer (at location B). Typically, the splicer will remove about seven yards of yarn from the upstream direction of the yarn and about a yard of yarn from the downstream direction. After the tension has been reset to the, desired level, the splicer then splices the yarn ends, releases the yarn, and the spinning device thereafter continues to manufacture the composite spun core multifilament yarn, which has been tensioned, and staple fibers, all without requiring any manual assistance.

Having described the presently preferred exemplary embodiment of a new and improved method and apparatus for automatically removing an imperfection from spun filament yarn and staple fibers, in accordance with the present invention, it is believed that other modifications, variations and changes will be suggested to those skilled in the art in view of the teachings set forth herein. For example, the vortex generator could apply a driving force to the core yarn by rollers which are selectively positioned to drive the core yarn downwardly. It is, therefore, to be understood that all such modifications, variations, and changes are believed to fall within the scope of the present invention as defined by the appended claims.

What is claimed is:

1. An apparatus for automating the removal of an imperfection detected while co-spinning of filament yarn and a sliver or roving of staple fibers, said apparatus comprising:

a pretension member selectively applying a predetermined tension to a supply of filament yarn;

a vortex generator disposed downstream from said pretension member, said vortex generator selectively applying a transport driving force to said filament yarn;

a cutting and clamping device disposed downstream from said vortex generator, said cutting and clamping device selectively clamping said filament yarn at a predetermined position and cutting said filament yarn downstream from said predetermined position;

a first pair of rollers selectively applying a driving force to said staple fibers;

a second pair of rollers disposed downstream from said cutting and clamping device and from said first pair of rollers, said second pair of rollers combining said staple fibers and said filament yarn;

a spinner disposed downstream from said second pair of rollers for covering said filament yarn with said staple fiber to form a combined filament yarn and staple fiber;

a sensor disposed downstream from said spinner, said sensor detects imperfections of a predetermined magnitude in said combined filament yarn and staple fiber; and control means being actuated in response to detection of an imperfection for stopping rotation of said first pair of rollers, actuating said cutting and clamping device to clamp said filament yarn and to cut said filament yarn.

2. An apparatus according to claim 1, further comprising a splicer disposed adjacent to and traversing with respect to said sensor, wherein said control means summons said splicer in response to detection of an imperfection.

3. An apparatus according to claim 2, wherein said control means generates a signal in response to the arrival of said splicer and substantially simultaneously, in response to said second signal, actuates said cutting and clamping device to release the tension on said filament yarn, actuates said vortex generator to apply said driving force to said filament yarn, and actuates said first pair of rollers to restart the feeding of said staple fibers.

4. An apparatus according to claim 3, wherein said control means actuates said splicer to cut said spun filament yarn and said staple fibers in a second predetermined position, to remove a predetermined amount, including said imperfection, of said spun filament yarn and staple fibers from both upstream and downstream of said second predetermined position, said control means actuates said pretension member to reapply said tension to said filament yarn, said control means actuates said splicer to splice said spun filament yarn and staple fibers at said second predetermined position.

5. An apparatus according to claim 4, further comprising a connecting funnel disposed downstream from said cutting and clamping device and upstream of said second pair of rollers.

6. An apparatus according to claim 5, further comprising a first feeder tube disposed downstream from said connecting funnel and upstream of said second pair of rollers.

7. An apparatus according to claim 6, further comprising a second feeder tube disposed downstream from said first feeder tube and upstream of said second pair of rollers.

8. An apparatus according to claim 7, wherein said first feeder tube has a smaller diameter than a diameter of the second feeder tube.

9. An apparatus according to claim 8, wherein the first feeder tube is spaced from said second feeder tube.

10. An apparatus according to claim 5, wherein said connecting funnel has a ceramic internal conical surface.

11. An apparatus according to claim 4, wherein the vortex generator includes a first through bore to permit the passage of the multifilament yarn and a second bore and a vortex chamber that are in fluid communication with said first through bore.

12. An apparatus according to claim 11, wherein the second through bore and said vortex chamber are in communication with a pneumatic supply line to direct an air pulse into said vortex generator through said second bore and said vortex chamber for applying said driving force to said staple fibers.

13. A method for automatically removing an imperfection from spun filament yarn and a sliver or roving of staple fibers, said method comprising the steps of:

feeding a sliver or roving of said staple fibers through a drafting apparatus to prepare a continuous bundle of staple fibers;

pretensioning said filament yarn such that a texture is temporarily substantially removed;

combining said continuous bundle of staple fibers and said pretensioned filament yarn downstream of said drafting apparatus;

feeding said combined continuous bundle and said filament yarn into a spinner;

spinning said combined continuous bundle and said filament yarn in said spinner;

monitoring said spun filament yarn and staple fibers to detect imperfection of a predetermined magnitude;

generating a first signal upon detection of an imperfection of said predetermined magnitude;

stopping the feeding of said staple fibers in response to said first signal;

clamping said filament yarn at a predetermined position in response to said first signal substantially simultaneously with said stopping;

cutting said filament yarn downstream of said predetermined position to relieve the tension on the portion of the filament yarn downstream from said clamping position; and removing said imperfection.

14. The method according to claim 13, further comprising the steps of:

summoning a splicer in response to said first signal;

generating a second signal in response to the arrival of said splicer;

substantially simultaneously, in response to said second signal, releasing the clamping of said filament yarn at said predetermined position, releasing said tension on said filament yarn, applying a downstream feeding force to said filament yarn, which is now substantially free of tension, at a position between a pretensioning device and said predetermined position and restarting the feeding of said staple fibers.

15. The method according to claim 14, further comprising the steps of:

cutting said spun filament yarn and said staple fibers in a second predetermined position by said splicer;

removing a predetermined amount, including said imperfection, of said spun filament yarn and staple fibers from both upstream and downstream of said second predetermined position;

reapplying said tension to said filament yarn;

splicing said spun filament yarn and staple fibers at said second predetermined position.

* * * * *